US010573437B2

(12) United States Patent
Horiuchi et al.

(10) Patent No.: US 10,573,437 B2
(45) **Date of Patent: *Feb. 25, 2020**

(54) PERMANENT MAGNET, AND MOTOR AND POWER GENERATOR USING THE SAME

(71) Applicant: KABUSHIKI KAISHA TOSHIBA, Minato-ku, Tokyo (JP)

(72) Inventors: Yosuke Horiuchi, Tokyo (JP); Shinya Sakurada, Tokyo (JP); Tsuyoshi Kobayashi, Kanagawa-ken (JP); Keiko Okamoto, Kanagawa-ken (JP); Masaya Hagiwara, Kanagawa-ken (JP)

(73) Assignee: KABUSHIKI KAISHA Toshiba, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/747,942

(22) Filed: Jan. 23, 2013

(65) Prior Publication Data

US 2013/0241682 A1 Sep. 19, 2013

(30) Foreign Application Priority Data

Mar. 15, 2012 (JP) ..... 2012-058867

(51) Int. Cl.

| | |
|---|---|
| ***H01F 1/01*** | (2006.01) |
| ***H01F 1/055*** | (2006.01) |
| ***C22C 1/02*** | (2006.01) |

(52) U.S. Cl.

CPC ..... *H01F 1/015* (2013.01); *C22C 1/02* (2013.01); *H01F 1/0557* (2013.01)

(58) Field of Classification Search

CPC ..... H01F 1/0577; H01F 10/126; H01F 7/02

See application file for complete search history.

(56) References Cited

U.S. PATENT DOCUMENTS

| | | | | |
|---|---|---|---|---|
| 4,746,378 | A | 5/1988 | Wysiekierski et al. | |
| 5,781,843 | A * | 7/1998 | Anderson et al. | 419/29 |
| 2011/0278976 | A1* | 11/2011 | Horiuchi | C22C 19/07 310/152 |
| 2012/0146444 | A1* | 6/2012 | Horiuchi et al. | 310/152 |

(Continued)

FOREIGN PATENT DOCUMENTS

| | | | | |
|---|---|---|---|---|
| JP | 59023803 A * | 2/1984 | ..... | C22C 1/0441 |
| JP | 06-212327 | 8/1994 | | |

(Continued)

OTHER PUBLICATIONS

English Machine Translation of JP H06-212327.*

(Continued)

*Primary Examiner* — Xiaowei Su

(74) *Attorney, Agent, or Firm* — Amin, Turocy & Watson, LLP

(57) ABSTRACT

In one embodiment, a permanent magnet includes: a composition expressed by $R_pFe_qM_rCu_sCo_{100-p-q-r-s}$ (R is a rare-earth element, M is at least one element selected from Zr, Ti, and Hf, 10.8≤p≤13.5 at %, 28≤q≤40 at %, 0.88≤r≤7.2 at %, and 3.5≤s≤13.5 at %); and a metallic structure including a cell phase having a $Th_2Zn_{17}$ crystal phase, and a cell wall phase. A Cu concentration in the cell wall phase is in a range from 30 at % to 70 at %.

16 Claims, 3 Drawing Sheets

(56) References Cited

U.S. PATENT DOCUMENTS

| | | | | |
|---|---|---|---|---|
| 2013/0076184 | A1* | 3/2013 | Horiuchi et al. | 310/152 |
| 2013/0241333 | A1 | 9/2013 | Horiuchi et al. | |
| 2013/0241681 | A1* | 9/2013 | Horiuchi et al. | 335/302 |
| 2014/0139064 | A1* | 5/2014 | Horiuchi | H01F 1/01 310/156.01 |
| 2015/0221422 | A1* | 8/2015 | Sakurada | C22C 1/00 310/152 |
| 2015/0270040 | A1* | 9/2015 | Horiuchi | C22C 19/07 310/152 |

FOREIGN PATENT DOCUMENTS

| | | | |
|---|---|---|---|
| JP | 07-138672 | A * | 5/1995 |
| JP | 09-111383 | | 4/1997 |
| JP | 2010-123722 | | 6/2010 |
| WO | 2011-016089 | | 2/2011 |
| WO | 2011016089 | A1 | 2/2011 |
| WO | 2011/121647 | A1 | 10/2011 |

OTHER PUBLICATIONS

Huang et al. J of Applied Physics, 1994, vol. 75, p. 6280-6282.*
Machine translation of JP07-138672A, May 1995.*
Machine translation of JP59-023803A, Feb. 1984.*
Liu et al. (IEEE Transactions on Magnetics, 1989, vol. 25, No. 5, p. 3785-3787).*
Translation of JP59-023803A (Year: 1984).*
Office Action of Notice of Reasons for Rejection for Japanese Patent Application No. 2012-058867 dated Sep. 3, 2013, 8 pgs.
Japanese Office Action for Japanese Patent Application No. 2014-031616 dated Mar. 3, 2015.
Office Action for Chinese Patent Application No. 201310037681.4 dated Jan. 6, 2015, 9 pages.
Notification of the Third Office Action for Chinese Patent Application No. 201310037681.4 dated Apr. 25, 2016, 5 pages.

* cited by examiner

PERMANENT MAGNET, AND MOTOR AND POWER GENERATOR USING THE SAME

CROSS-REFERENCE TO RELATED APPLICATION

This application is based upon and claims the benefit of priority from Japanese Patent Application No. 2012-058867, filed on Mar. 15, 2012; the entire contents of which are incorporated herein by reference.

FIELD

Embodiments disclosed herein generally relate to a permanent magnet, and a motor and a power generator using the same.

BACKGROUND

As a high-performance permanent magnet, there have been known rare-earth magnets such as a Sm—Co based magnet and a Nd—Fe—B based magnet. When a permanent magnet is used for a motor of a hybrid electric vehicle (HEV) or an electric vehicle (EV), the permanent magnet is required to have heat resistance. In a motor for HEV or EV, a permanent magnet whose heat resistance is enhanced by Dy substituting for part of Nd of the Nd—Fe—B based magnet is used. Since Dy is one of rare elements, there is a demand for a permanent magnet not using Dy. As a motor and a power generator with high efficiency, a variable magnetic flux motor and a variable magnetic flux power generator using a variable magnet and a stationary magnet are known. In order to improve performance and efficiency of the variable magnetic flux motor and the variable magnetic flux power generator, there is a demand for improvement in a coercive force and magnetic flux density of the variable magnet and the stationary magnet.

It is known that, because the Sm—Co based magnet has a high Curie temperature, it exhibits excellent heat resistance without using Dy and is capable of realizing a good motor characteristic and so on at high temperatures. A $Sm_2Co_{17}$ type magnet among the Sm—Co based magnets is usable as a variable magnet owing to its coercive force exhibiting mechanism and so on. Improvement in coercive force and magnetic flux density is also required of the Sm—Co based magnet. In order to increase magnetic flux density of the Sm—Co based magnet, it is effective to increase Fe concentration, but the coercive force tends to decrease in a composition range where the Fe concentration is high. Under such circumstances, there is a demand for a technique for making a Sm—Co based magnet having a high Fe concentration exhibit a high coercive force.

DETAILED DESCRIPTION

Figure 1:
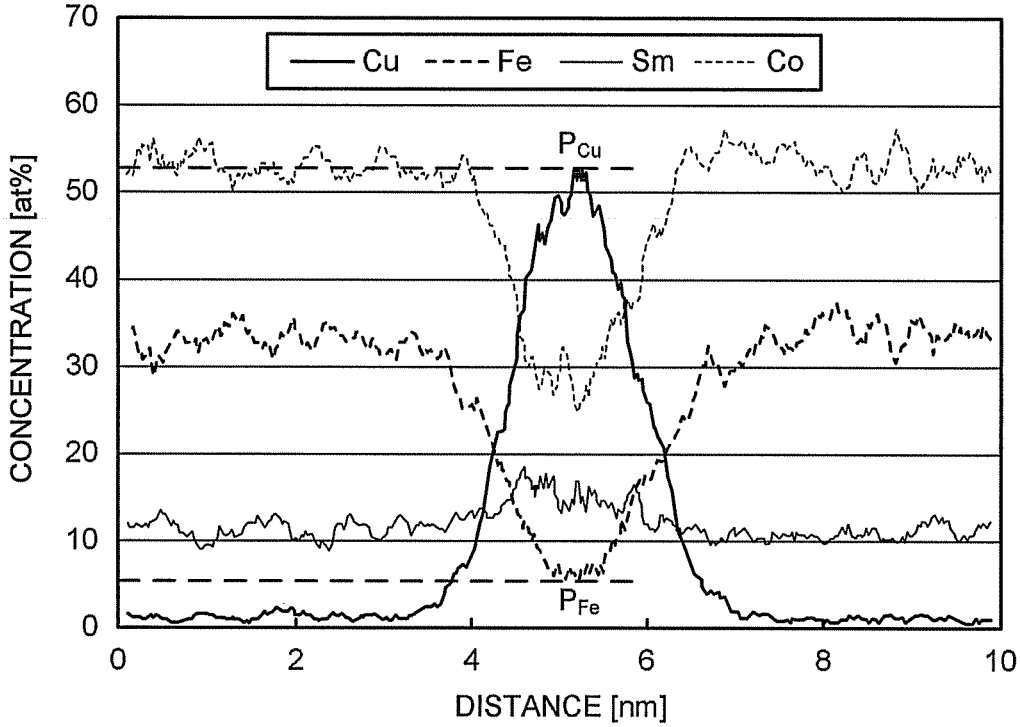
FIG. 1 is a chart showing an example of concentration profiles of constituent elements near a cell wall phase in a permanent magnet of an embodiment.

According to one embodiment, there is provided a permanent magnet including: a composition expressed by a composition formula:

$$R_pFe_qM_rCu_sCo_{100-p-q-r-s} \quad (1),$$

where R is at least one element selected from rare-earth elements, M is at least one element selected from Zr, Ti, and Hf, p is a number satisfying $10.8 \le p \le 13.5$ at %, q is a number satisfying $28 \le q \le 40$ at %, r is a number satisfying $0.88 \le r \le 7.2$ at %, and s is a number satisfying $3.5 \le s \le 13.5$ at %; and a metallic structure including a cell phase and a cell wall phase. The cell phase has a $Th_2Zn_{17}$ crystal phase. The cell wall phase exists to surround the cell phase. In the above-described permanent magnet, a Cu concentration in the cell wall phase is in a range from 30 at % to 70 at %.

Hereinafter, the permanent magnet of the embodiment will be described in detail. In the composition formula (1), as the element R, at least one element selected from rare-earth elements including yttrium (Y) is used. Any of the elements R brings about great magnetic anisotropy and gives a high coercive force to the permanent magnet. As the element R, at least one element selected from samarium (Sm), cerium (Ce), neodymium (Nd), and praseodymium (Pr) is preferably used, and the use of Sm is especially desirable. When 50 at % or more of the element R is Sm, it is possible to enhance performance, especially the coercive force, of the permanent magnet with good reproducibility. Further, 70 at % or more of the element R is desirably Sm.

The content p of the element R is set to a range not less than 10.8 at % nor more than 13.5 at %. When the content p of the element R is less than 10.8 at %, it is not possible to obtain a sufficient coercive force because of reasons such as the precipitation of a large amount of an α-Fe phase. On the other hand, when the content p of the element R is over 13.5 at %, saturation magnetization greatly decreases. The content p of the element R is preferably set to a range from 11.0 at % to 13 at %, and more preferably a range from 11.2 at % to 12.5 at %.

Iron (Fe) is an element mainly responsible for the magnetization of the permanent magnet. When a large amount of Fe is contained, it is possible to increase saturation magnetization of the permanent magnet. However, when an excessively large amount of Fe is contained, the α-Fe phase precipitates and it is difficult to obtain a later-described desired two-phase separation structure, which is liable to lower the coercive force. Therefore, the content q of Fe is set to a range not less than 28 at % nor more than 40 at %. The content q of Fe is preferably set to a range from 29 at % to 38 at %, and more preferably a range from 30 at % to 36 at %.

As the element M, at least one element selected from titanium (Ti), zirconium (Zr), and hafnium (Hf) is used. Compounding the element M makes it possible for a large coercive force to be exhibited even when the Fe concentration of the composition is high. The content r of the element M is set to a range not less than 0.88 at % nor more than 7.2 at %. By setting the content r of the element M to 0.88 at % or more, it is possible for the permanent magnet having the composition with a high Fe concentration to exhibit a high coercive force. On the other hand, when the content r of the element M is over 7.2 at %, the magnetization greatly lowers. The content r of the element M is preferably set to a range from 1.3 at % to 4.3 at %, and more preferably a range from 1.5 at % to 2.6 at %.

The element M may be any of Ti, Zr, and Hf, but preferably contains at least Zr. Especially when 50 at % or more of the element M is Zr, it is possible to further improve the effect of enhancing the coercive force of the permanent magnet. On the other hand, Hf in the element M is especially expensive, and therefore, even when Hf is used, its amount used is preferably small. The content of Hf is preferably set to less than 20 at % of the element M.

Copper (Cu) is an element for causing the permanent magnet to exhibit a high coercive force. The content s of Cu is set to a range not less than 3.5 at % nor more than 13.5 at %. When the content s of Cu is less than 3.5 at %, it is difficult to obtain a high coercive force. When the content s of Cu is over 13.5 at %, the magnetization greatly lowers. The compounding amount s of Cu is preferably set to a range from 3.9 at % to 9 at %, and more preferably a range from 4.2 at % to 7.2 at %.

Cobalt (Co) is an element not only responsible for the magnetization of the permanent magnet but also necessary for causing a high coercive force to be exhibited. Further, when a large amount of Co is contained, a Curie temperature becomes high, which improves thermal stability of the permanent magnet. When the content of Co is too small, it is not possible to sufficiently obtain these effects. However, when the content of Co is excessively large, a ratio of the Fe content relatively lowers, which deteriorates the magnetization. Therefore, the content of Co is set in consideration of the contents of the element R, the element M, and Cu so that the content of Fe satisfies the aforesaid range.

Part of Co may be substituted for by at least one element A selected from nickel (Ni), vanadium (V), chromium (Cr), manganese (Mn), aluminum (Al), gallium (Ga), niobium (Nb), tantalum (Ta), and tungsten (W). These substitution elements A contribute to improvement in magnetic property, for example, the coercive force. However, the excessive substitution by the element A for Co is liable to cause the deterioration of the magnetization, and therefore, an amount of the substitution by the element A is preferably 20 at % of Co or less.

In the permanent magnet of this embodiment, the Cu concentration in the cell wall phase falls within the range from 30 at % to 70 at %. It is known that a coercive force exhibiting mechanism of a $Sm_2Co_{17}$ type magnet is a domain wall pinning type, and the coercive force stems from a nano-phase separation structure generated by heat treatment. The nano-phase separation structure (two-phase separation structure) includes a cell phase having a $Th_2Zn_{17}$ crystal phase (a crystal phase having a $Th_2Zn_{17}$ structure/2-17 phase), and a cell wall phase formed to surround a periphery of the cell phase and having a $CaCu_5$ crystal phase (a crystal phase having a $CaCu_5$ structure/1-5 phase). It is thought that the cell wall phase works as the pinning site of the domain wall to inhibit displacement of the domain wall, so that the domain wall pinning-type coercive force is exhibited.

A possible reason why the displacement of the domain wall is inhibited by the cell wall phase is a difference in domain wall energy between the cell phase and the cell wall phase. It is thought that the difference in the domain wall energy stems from a ratio of constituent elements of the cell phase and the cell wall phase, and it is especially important that Cu is condensed in the cell wall phase to form a potential well. Therefore, it has been thought to be effective to make the cell phase and the cell wall phase different in the Cu concentration. Actually, regarding a conventional $Sm_2Co_{17}$ type magnet having a composition with a low Fe concentration, it has been reported that the Cu concentration in the cell wall phase is higher than that in the cell phase, and the Cu concentration in the cell wall phase is increased up to about 20 at %.

However, in a $Sm_2Co_{17}$ type magnet having a high Fe concentration, even though it has been confirmed that the Cu concentration in the cell wall phase is about 20 at %, a sufficient coercive force cannot be obtained. As a result of studious studies about a reason for this, it has been made clear that in a $Sm_2Co_{17}$ type magnet having a composition in which the Fe concentration is 28 at % or more, Cu and Fe, Co mutually diffuse, and even when the Cu concentration in the cell wall phase becomes about 20 at % similarly to that in the conventional $Sm_2Co_{17}$ type magnet having a low Fe concentration, the Fe concentration in the cell wall phase is still high. When the Fe concentration in the cell wall phase is left high, Fe whose concentration is high lowers magnetic anisotropy, so that the effect of the cell wall phase as the domain wall pinning site weakens. This is thought to be a reason why a sufficient coercive force is not obtained in the conventional $Sm_2Co_{17}$ type magnet having a high Fe concentration.

In the permanent magnet of this embodiment, the Cu concentration in the cell wall phase falls within the range from 30 at % to 70 at %. Even when a composition with a high Fe concentration is used, by further increasing the Cu concentration in the cell wall phase, the cell wall phase functions as the pinning site of the domain wall. Accordingly, it is possible to enhance the coercive force of the $Sm_2Co_{17}$ type magnet having the composition whose Fe concentration is 28 at % or more. When the composition whose Fe concentration is 28 at % or more is used, if the Cu concentration in the cell wall phase is less than 30 at %, it is not possible to make the cell phase and the cell wall phase sufficiently different in the domain wall energy. Therefore, it is not possible to make the $Sm_2Co_{17}$ type magnet exhibit a large coercive force. With the Cu concentration in the cell wall phase realized in the conventional $Sm_2Co_{17}$ type magnet, that is, about 20 at %, it is not possible to obtain a sufficient coercive force of the $Sm_2Co_{17}$ type magnet having the high Fe concentration.

When the Cu concentration in the cell wall phase is too high, a crystal structure of the cell wall phase becomes unstable, so that it is not possible to stably generate the cell wall phase. This makes it impossible to obtain the coercive force of the domain wall pinning type. Therefore, when the composition whose Fe concentration is 28 at % or more is used, the Cu concentration in the cell wall phase is set to the range not less than 30 at % nor more than 70 at %. The Cu concentration in the cell wall phase is preferably 65 at % or less, and more preferably 60 at % or less. In order to enhance the function of the cell wall phase as the domain wall pinning site, the Cu concentration in the cell wall phase is preferably 35 at % or more, and more preferably 45 at % or more.

That the condensation of Cu into the cell wall phase progresses means that the mutual diffusion of Cu and Fe is more effectively progressing. Therefore, when the Cu concentration in the cell wall phase is increased, the Fe concentration in the cell wall phase decreases. This also increases the difference in the domain wall energy between the cell phase and the cell wall phase, and hence can further enhance the coercive force of the $Sm_2Co_{17}$ type magnet having a high Fe concentration. The Fe concentration in the cell wall phase preferably falls within a range from 4 at % to 20 at %. Further, since the element R such as Sm is also condensed in the cell wall phase, the concentration of the element R in the cell wall phase preferably falls within a range from 12 at % to 28 at %. The concentration of the element M in the cell wall phase preferably falls within a range from 0.1 at % to 3 at %.

When the Cu concentration in the cell wall phase falls within the range from 30 at % to 70 at %, it is possible for the cell wall phase to sufficiently function as the pinning site of the domain wall. A typical example of the cell wall phase is the aforesaid 1-5 phase, but the cell wall phase is not limited to this. If the cell wall phase has a sufficient Cu concentration, the cell wall phase functions as the pinning site of the domain wall. The cell wall phase only needs to be such a phase. Besides the 1-5 phase, examples of the cell wall phase are a $TbCu_7$ crystal phase (a crystal phase having a $TbCu_7$ structure/1-7 phase) being a high-temperature phase (structure before the phase separation), a precursor phase of the 1-5 phase that is generated in an initial stage of the two-phase separation of the 1-7 phase, and the like.

In order to enhance the magnetization of the permanent magnet, the Fe concentration in the cell phase preferably falls within a range from 28 at % to 45 at %. The condensation of Cu and the element R such as Sm in the cell wall phase progresses, so that the concentration of Cu and the concentration of the element R become lower than those of an initial alloy composition (composition of magnetic powder being a raw material of a sintered compact). Therefore, the Cu concentration in the cell phase preferably falls within a range from 0.5 at % to 10 at %. The concentration of the element R in the cell phase preferably falls within a range from 8 at % to 18 at %. The concentration of the element M in the cell phase preferably falls within a range from 0.1 at % to 3 at %.

The cell phase preferably has a composition expressed by the following composition formula (2). The cell wall phase preferably has a composition expressed by the following composition formula (3).

$$\text{composition formula: } R_{p1}Fe_{q1}M_{r1}Cu_{s1}Co_{100-p1-q1-r1-s1} \quad (2)$$

where, p1 is a number satisfying 8≤p1≤18 at %, q1 is a number satisfying 28≤q1≤45 at %, r1 is a number satisfying 0.1≤r1≤3 at %, and s1 is a number satisfying 0.5≤s1≤10 at %.

$$\text{composition formula: } R_{p2}Fe_{q2}M_{r2}Cu_{s2}Co_{100-p2-q2-r2-s2} \quad (3)$$

where, p2 is a number satisfying 12≤p2≤28 at %, q2 is a number satisfying 4≤q2≤20 at %, r2 is a number satisfying 0.1≤r2≤3 at %, and s2 is a number satisfying 30≤s2≤70 at %.

In the permanent magnet including the sintered compact expressed by the composition formula (1), the Cu concentration difference between the cell phase and the cell wall phase is thought to occur at the time of aging or at the time of later gradual cooling. However, when the composition with a high Fe concentration is employed, only by controlling aging conditions, it is difficult for a sufficient Cu concentration difference to occur between the cell phase and the cell wall phase. Therefore, in order to realize the aforesaid Cu concentration in the cell wall phase, it is necessary to increase the density of the sintered compact to increase a diffusible area. However, Sm—Co based magnetic powder (alloy powder) having a high F concentration is low in sinterability, and thus it is difficult to obtain a high density of the sintered compact. When the Fe concentration of the allow powder is high, a hetero-phase in which the concentrations of Cu and the element M are high is easily generated, and it is thought that this hetero-phase deteriorates the sinterability. For the progress of the mutual diffusion of Fe and Cu, it is important to suppress the generation of the hetero-phase to improve the sinterability of the magnetic powder having a high Fe concentration.

The sintering of the Sm—Co based magnetic powder (alloy powder) is generally performed in an inert gas atmosphere such as Ar gas or in a vacuum atmosphere. The sintering in the inert gas atmosphere has a merit of being capable of suppressing the evaporation of Sm having a high vapor pressure to make composition deviation difficult to occur. However, in the inert gas atmosphere, it is difficult to avoid the generation of the hetero-phase. Moreover, the inert gas such as the Ar gas remains in pores to make the pores difficult to disappear, which makes it difficult to increase the density of the sintered compact. On the other hand, it has been made clear that the sintering in the vacuum atmosphere can suppress the generation of the hetero-phase. However, an evaporation amount of Sm or the like having a high vapor pressure becomes large in the vacuum atmosphere, which makes it difficult to control the composition of the sintered compact to an alloy composition suitable as the permanent magnet.

As a solution to such problems, it is effective to perform a final sintering step (main sintering step) in the inert gas atmosphere of Ar gas or the like after a pre-process step (temporary sintering step) in the vacuum atmosphere is performed. By employing such a sintering step having the pre-process step in the vacuum atmosphere and the main sintering step in the inert gas atmosphere, it is possible to suppress the evaporation of Sm or the like having a high vapor pressure while suppressing the generation of the hetero-phase in which the concentrations of Cu and the element M are high. Therefore, it is possible to obtain the sintered compact with a high density and a small composition deviation when the magnetic powder (alloy powder) having a high Fe concentration is used. By obtaining the sintered compact with a high density and a small composition deviation, it is possible to make the mutual diffusion of Fe and Cu fully progress in later solution treatment and aging. This makes it possible to sufficiently increase the Cu concentration in the cell wall phase.

When the magnetic powder (alloy powder) having a Fe concentration of about 20 at % is sintered, setting a temperature of the temporary sintering step lower than a temperature of the main sintering step by a certain degree is effective for increasing the density. On the other hand, when the magnetic powder (alloy powder) having a Fe concentration of 28 at % or more is sintered, it is preferable to keep the vacuum atmosphere until the temperature becomes as close to the temperature of the main sintering step as possible. Further, keeping the vacuum atmosphere until the temperature of the main sintering is reached is also effective. In this case as well, by changing to the inert gas at the same time when the temperature of the main sintering is reached, it is possible to suppress the evaporation of Sm or the like during the sintering. A reason why it is preferable to keep the vacuum atmosphere until the temperature becomes close to the temperature of the main sintering when the composition is in the range having a high Fe concentration is thought to be that keeping the vacuum atmosphere until the temperature becomes as high as possible makes it possible to more effectively suppress the generation of the hetero-phase. Concrete conditions in the sintering step of the magnetic powder will be described in detail later.

By subjecting the aforesaid high-density sintered compact to the solution treatment and the aging, it is possible to increase the Cu concentration in the cell wall phase with good reproducibility. This makes it possible to enhance the coercive force of the Sm—Co based magnet having the composition with a high Fe concentration. Specifically, the permanent magnet of this embodiment realizes the enhancement in the magnetization based on the Fe concentration of 28 at % or more and at the same time realizes the enhancement in the coercive force by setting the Cu concentration to the range from 30 at % to 70 at %. That is, the permanent magnet of this embodiment realizes both a high coercive force and high magnetization in the Sm—Co based magnet. The coercive force of the permanent magnet of the embodiment is preferably 800 kA/m or more, and the residual magnetization is preferably 1.15 T or more.

The density of the sintered compact of the Sm—Co based magnetic powder (alloy powder) is preferably $8.2\times10^3$ kg/m$^3$ or more from a practical point of view. By realizing such a density of the sintered compact, it is possible to make the mutual diffusion of Fe and Cu fully progress in the solution treatment step and the aging step to sufficiently increase the Cu concentration in the cell wall phase. The permanent magnet of the embodiment is preferably a sintered magnet that includes a sintered compact including the composition expressed by the composition formula (1) and the metallic structure having the cell phase and the cell wall phase, wherein the density of the sintered compact is $8.2\times10^3$ kg/m$^3$ or more.

It is possible to observe the metallic structure having a cell-like structure by using a transmission electron microscope (TEM). The concentrations of the respective elements in the cell phase and the cell wall phase can be measured with the use of, for example, a TEM-energy dispersive X-ray spectroscopy (TEM-EDX) or a 3 dimensional atom probe (3DAP). The TEM observation is preferably conducted with a magnification of 100 k to 200 k times. In the permanent magnet including the sintered compact whose magnetic field is oriented, a cross section including a c-axis of the 2-17 phase being the cell phase is preferably observed.

3DAP is preferably used for the measurement of the concentrations of the respective elements in the cell wall phase. There is a possibility that by the TEM-EDX observation, it is not possible to accurately measure the concentrations of the respective elements in the cell wall phase because transmission electron beams permeate through both the cell wall phase and the cell phase even if the cell wall phase is observed. For example, the Sm concentration or the like sometimes becomes slightly high (about 1.2 to 1.5 times a measurement value by 3DAP).

The measurement of the concentrations of the elements in the cell wall phase by 3DAP is carried out according to the following procedure. A sample is thinned by dicing, and from the thinned sample, a needle-shaped sample for pickup atom probe (AP) is prepared by focused iron beam (FIB). An atom map is created based on an inter-plane interval (about 0.4 nm) of atomic planes (0003) of the 2-17 phase parallel to a plate-shaped phase rich with the element M such as Zr (M-rich phase) generated perpendicularly to the c-axis in the 2-17 phase. Regarding atom probe data thus created, a profile of only Cu is created, and a place where Cu is condensed is specified. This part rich with Cu is the cell wall phase.

Concentration profiles of the respective elements are analyzed in a direction perpendicular to the cell wall phase. An analysis range from the concentration profiles is preferably 10×10×10 nm or 5×5×10 nm. An example of the concentration profiles of the respective elements obtained by such analysis is shown in FIG. 1. The concentrations of the respective elements in the cell wall phase are measured from such concentration profiles. When the Cu concentration in the cell wall phase is measured, a highest value ($P_{Cu}$) of the Cu concentration is found from the Cu profile. Such measurement is conducted for 20 points in the same sample, and an average value thereof is defined as the Cu concentration in the cell wall phase. The concentration of the element R such as Sm is also measured in the same manner. When the Fe concentration in the cell wall phase is measured, a lowest value ($P_{Fe}$) of the Fe concentration is found from the Fe profile. Such measurement is conducted for 20 points in the same sample, and an average value thereof is defined as the Fe concentration in the cell wall phase. The concentration of the element M such as Zr and the concentration of Co are also measured in the same manner.

The measurement by TEM-EDX or 3DAP is conducted for the interior of the sintered compact. The measurement of the interior of the sintered compact means as follows. The composition is measured in a surface portion and the interior of a cross section cut at a center portion of the longest side in a surface having the largest area, perpendicularly to the side (perpendicularly to a tangent of the center portion in a case of a curve). Measurement points are as follows. Reference lines 1 drawn from ½ positions of respective sides in the aforesaid cross section as starting points up to end portions toward an inner side perpendicularly to the sides and reference lines 2 drawn from centers of respective corners as starting points up to end portions toward the inner side at ½ positions of interior angles of the corner portions are provided, and 1% positions of the lengths of the reference lines from the starting points of these reference lines 1, 2 are defined as the surface portion and 40% positions are defined as the interior. Note that, when the corner portions have curvature because of chamfering or the like, points of intersection of extensions of adjacent sides are defined as end portions of the sides (centers of the corner portions). In this case, the measurement points are positions determined not based on the points of intersection but based on portions in contact with the reference lines.

When the measurement points are set as above, in a case where the cross section is, for example, a quadrangle, the number of the reference lines is totally eight, with the four reference lines 1 and the four reference lines 2, and the number of the measurement points is eight in each of the surface portion and the interior. In this embodiment, the eight points in each of the surface portion and the interior all preferably have the composition within the aforesaid range, but at least four points or more in each of the surface portion and the interior need to have the composition within the aforesaid range. In this case, a relation between the surface portion and the interior of one reference line is not defined. The observation is conducted after an observation surface of the interior of the sintered compact thus defined is smoothed by polishing. For example, the observation points of TEM-EDX are arbitrary 20 points in the cell phase and the cell wall phase, and an average value of measurement values except the maximum value and the minimum value of the measurement values at these points is found, and this average value is set as the concentration of each element. This also applies to the measurement by 3DAP.

In the results of the aforesaid measurement of the concentrations in the cell wall phase using 3DAP, the sharper the Cu concentration profile in the cell wall phase is, the more preferable. Concretely, a full width at half maximum (FWHM) of the Cu concentration profile is preferably 5 nm or less. In such a case, a higher coercive force can be obtained. This is because, when the distribution of Cu in the cell wall phase is sharp, a difference in the domain wall energy sharply occurs between the cell phase and the cell wall phase and the domain wall is more easily pinned.

The full width at half maximum (FWHM) of the concentration profile of Cu in the cell wall phase is found as follows. Based on the aforesaid method, the highest value ($P_{Cu}$) of the Cu concentration is found from the Cu profile of 3DAP, and a width of a peak whose value is half the aforesaid value ($P_{Cu}/2$), that is, the full width at half maximum (FWHM) is found. Such measurement is conducted for ten peaks and an average value of obtained values is defined as the full width at half maximum (FWHM) of the Cu profile. When the full width at half maximum (FWHM) of the Cu profile is 3 nm or less, the effect of enhancing the coercive force further improves, and when it is 2 nm or less, it is possible to obtain a sill more excellent effect of improving the coercive force.

The permanent magnet of this embodiment is fabricated as follows, for instance. First, alloy powder containing predetermined amounts of elements is fabricated. The alloy powder is prepared by grinding an alloy ingot obtained through the casting of molten metal by an arc melting method or a high-frequency melting method. The alloy powder may be prepared by fabricating an alloy thin strip in a flake form by a strip cast method and thereafter grinding the alloy thin strip. In the strip cast method, it is preferable that the alloy molten metal is tiltingly injected to a chill roll rotating at a 0.1 m/second to 20 m/second circumferential speed and a thin strip with a 1 mm thickness or less is continuously obtained. When the circumferential speed of the chill roll is less than 0.1 m/second, a composition variation is likely to occur in the thin strip, and when the circumferential speed is over 20 m/second, crystal grains become fine to a single domain size or less and a good magnetic property cannot be obtained. The circumferential speed of the chill roll preferably falls within a range from 0.3 m/second to 15 m/second, and more preferably within a range from 0.5 m/second to 12 m/second.

Other examples of the method of preparing the alloy powder are a mechanical ironing method, a mechanical grinding method, a gas atomization method, a reduction diffusion method, and the like. The alloy powder prepared by any of these methods may be used. The alloy powder thus obtained or the alloy before being ground may be heat-treated for homogenization when necessary. A jet mill or a ball mill is used for grinding the flake or the ingot. The grinding is preferably performed in an inert gas atmosphere or an organic solvent in order to prevent oxidization of the alloy powder.

Next, the alloy powder is filled in a mold installed in an electromagnet or the like and is press-formed while a magnetic field is applied. Consequently, a compression-molded body whose crystal axes are oriented is fabricated. By sintering the compression-molded body under appropriate conditions, it is possible to obtain a sintered compact having a high density. The sintering step of the compression-molded body preferably includes the pre-process step in the vacuum atmosphere and the main sintering step in the inert gas atmosphere as previously described. A main sintering temperature Ts is preferably 1210° C. or lower. When the Fe concentration is high, it is expected that a melting point lowers, and therefore, Sm or the like easily evaporates when the main sintering temperature Ts is too high. The main sintering temperature Ts is more preferably 1205° C. or lower, and more preferably 1200° C. or lower. However, in order to increase the density of the sintered compact, the main sintering temperature Ts is preferably 1170° C. or higher, and more preferably 1180° C. or higher.

In the main sintering step in the inert gas atmosphere, a sintering time at the aforesaid main sintering temperature Ts is preferably 0.5 hour to 15 hours. This makes it possible to obtain a dense sintered compact. When the sintering time is less than 0.5 hour, the density of the sintered compact becomes uneven. When the sintering time is over 15 hours, Sm or the like in the alloy powder evaporates, which is liable to make it impossible to obtain a good magnetic property. The sintering time is more preferably one hour to ten hours, and still more preferably one hour to four hours. The main sintering step is performed in the inert gas atmosphere of Ar gas or the like.

As previously described, in order to turn the compression-molded body of the alloy powder having a high Fe concentration to the high-density sintered compact, the pre-process step is preferably performed in the vacuum atmosphere prior to the main sintering step. Further, it is preferable that the vacuum atmosphere is kept until the temperature becomes close to the main sintering temperature. Concretely, in order for the sintered compact to have a density of $8.2\times10^3$ kg/m$^3$ or more, the temperature (pre-process temperature) T [° C.] at the time of the change from the vacuum atmosphere to the inert gas atmosphere preferably falls within a temperature range not lower than a temperature that is lower than the main sintering temperature Ts [° C.] by 50° C. (Ts−50° C.) nor higher than the main sintering temperature Ts (Ts−50° C.≤T≤Ts). When the atmosphere change temperature T is lower than the main sintering temperature Ts by more than 50° C. (T<Ts−50° C.), it might not be possible to sufficiently increase the density of the sintered compact. Moreover, the hetero-phase existing in the compression-molded body or the hetero-phase generated at the time of the temperature increase in the sintering step remains even after the main sintering step, which is liable to lower the magnetization.

When the atmosphere change temperature T is too lower than the main sintering temperature Ts, it is not possible to fully obtain the effect of suppressing the generation of the hetero-phase in the pre-process step in the vacuum atmosphere. Accordingly, it is not possible to increase the density of the sintered compact, which lowers both the magnetization and the coercive force. The atmosphere change temperature T is more preferably equal to or higher than a temperature that is lower than the main sintering temperature Ts by 40° C. (Ts−40° C.), and still more preferably equal to or higher than a temperature that is lower than the main sintering temperature Ts by 30° C. (Ts−30° C.). When the process temperature T in the vacuum atmosphere is higher than the main sintering temperature Ts, Sm evaporates to deteriorate the magnetic property, and therefore, the atmosphere change temperature T is set to the main sintering temperature Ts or lower. The change from the vacuum atmosphere to the inert gas atmosphere may take place at the same time when the main sintering temperature Ts is reached.

A degree of vacuum of the vacuum atmosphere in the pre-process step is preferably $9\times10^{-2}$ Pa or less. When the degree of vacuum of the pre-process step is over $9\times10^{-2}$ Pa, an oxide of the element R such as Sm is liable to be excessively formed. By setting the degree of vacuum in the pre-process step to $9\times10^{-2}$ Pa or less, it is possible to more clearly obtain the effect of increasing the Cu concentration in the cell wall phase. The degree of vacuum of the pre-process step is more preferably $5\times10^{-2}$ Pa or less, and still more preferably $1\times10^{-2}$ Pa or less. The process time of the pre-process step is preferably shorter than the main sintering time. When the process time is too long, an evaporation amount of the element R such as Sm is liable to increase.

Further, it is also effective to keep the vacuum atmosphere for one minute or more at the time of the change from the vacuum atmosphere to the inert gas atmosphere. This makes it possible to further promote the density increase of the sintered compact. When the atmosphere change temperature T is lower than the main sintering temperature Ts, the atmosphere change temperature T is kept for a predetermined time. When the atmosphere change temperature T is set to a temperature equal to the main sintering temperature Ts, the temperature is increased up to the main sintering temperature Ts after the temperature lower than the main sintering temperature Ts is kept for the predetermined time in the vacuum atmosphere, and the atmospheres are changed.

The main sintering step in the inert gas atmosphere follows the pre-process step in the vacuum atmosphere. In this case, the vacuum atmosphere is changed to the inert gas atmosphere at the same time when the main sintering temperature Ts is reached, the vacuum atmosphere is changed to the inert gas atmosphere when the atmosphere change temperature T which is equal to or higher than the temperature that is lower than the main sintering temperature Ts by 50° C. (Ts−50° C.) is reached, or the vacuum atmosphere is changed to the inert gas atmosphere after the atmosphere change temperature T is kept for a predetermined time. The pre-process step in the vacuum atmosphere and the main sintering step in the inert gas atmosphere may be performed as separate steps. In this case, the temperature is increased up to the atmosphere change temperature (pre-process temperature) T in the vacuum atmosphere, and when necessary, after this temperature is kept for the predetermined time, cooling is performed. Next, after the vacuum atmosphere is changed to the inert gas atmosphere, the temperature is increased up to the main sintering temperature Ts and the main sintering step is performed.

Next, the solution treatment and the aging are applied to the obtained sintered compact to control the crystal structure. The solution treatment is preferably 0.5-hour to eight-hour heat treatment at the temperature range from 1100° C. to 1200° C. in order to obtain the 1-7 phase being the precursor of the phase separation structure. When the temperature is lower than 1100° C. or is over 1200° C., a ratio of the 1-7 phase in a sample having undergone the solution treatment is small and a good magnetic property is not obtained. The temperature of the solution treatment more preferably falls within a range from 1120° C. to 1180° C., and more preferably within a range from 1120° C. to 1170° C.

When the solution treatment time is less than 0.5 hour, the constituent phase is likely to be uneven, which is liable to make it impossible to obtain a more sufficient density. When the solution treatment time is over eight hours, the element R such as Sm in the sintered compact evaporates, which is liable to make it impossible to obtain a good magnetic property. The solution treatment time more preferably falls within a range from one hour to eight hours, and more preferably within a range from one hour to four hours. For the prevention of oxidation, the solution treatment is preferably performed in the vacuum atmosphere or the inert gas atmosphere of Ar gas or the like.

Next, the aging is applied to the sintered compact having undergone the solution treatment. The aging is treatment to control the crystal structure to enhance the coercive force of the magnet. In the aging, it is preferable that after the temperature is kept at 700° C. to 900° C. for 0.5 hour to 80 hours, the temperature is gradually decreased to 400° C. to 650° C. at a cooling rate of 0.2° C./minute to 2° C./minute, and the temperature is subsequently decreased to room temperature. The aging may be performed by two-stage heat treatment. Specifically, the aforesaid heat treatment is the first stage and after the temperature is gradually decreased to 400° C. to 650° C., the second-stage heat treatment is subsequently performed. After the temperature of the second-stage heat treatment is kept for a certain time, the temperature is decreased to room temperature by furnace cooling. In order to prevent oxidation, the aging is preferably performed in the vacuum atmosphere or the inert gas atmosphere of Ar gas.

When the aging temperature is lower than 700° C. or is over 900° C., it is not possible to obtain a uniform mixed structure of the cell phase and the cell wall phase, which is liable to deteriorate the magnetic property of the permanent magnet. The aging temperature is more preferably 750° C. to 880° C., and still more preferably 780° C. to 850° C. When the aging time is less than 0.5 hour, the precipitation of the cell wall phase from the 1-7 phase might not be fully completed. When the retention time is over eighty hours, the thickness of the cell wall phase becomes large, so that a volume fraction of the cell phase lowers and crystal grains roughen, which is liable to make it impossible to obtain a good magnetic property. The aging time is more preferably four hours to sixty hours, and still more preferably eight hours to forty hours.

When the cooling rate of the aging treatment is less than 0.2° C./minute, the thickness of the cell wall phase becomes large, so that the volume fraction of the cell phase lowers or the crystal grains roughen, which is liable to make it impossible to obtain a good magnetic property. When the cooling rate after the aging heat treatment is over 2° C./minute, it is not possible to obtain a uniform mixed structure of the cell phase and the cell wall phase, which is liable to deteriorate the magnetic property of the permanent magnet. The cooling rate after the aging heat treatment is more preferably set to a range from 0.4° C./minute to 1.5° C./minute, and still more preferably a range from 0.5° C./minute to 1.3° C./minute.

Note that the aging is not limited to the two-stage heat treatment but may be heat treatment in more multiple stages, and it is also effective to perform multi-stage cooling. Further, as a pre-process of the aging, it is also effective to perform preliminary aging at a temperature lower than that of the aging for a short time. Consequently, the effect of increasing the Cu concentration in the cell wall phase further improves and it is also expected that squareness of a magnetization curve also improves. Concretely, by setting the temperature of the preliminary aging to 600° C. to 780° C., setting the treatment time to 0.5 hour to four hours, and setting the gradual cooling rate after the preliminary aging to 0.5° C./minute to 1.5° C./minute, the improvement in the properties of the permanent magnet is expected.

The permanent magnet of this embodiment is usable in various kinds of motors and power generators. The permanent magnet of the embodiment is also usable as a stationary magnet and a variable magnet of a variable magnetic flux motor and a variable magnetic flux power generator. Various kinds of motors and power generators are structured by the use of the permanent magnet of this embodiment. When the permanent magnet of this embodiment is applied to a variable magnetic flux motor, arts disclosed in Japanese Patent Application Laid-open No. 2008-29148 and Japanese Patent Application Laid-open No. 2008-43172 are applicable as a structure and a drive system of the variable magnetic flux motor.

Figure 2:
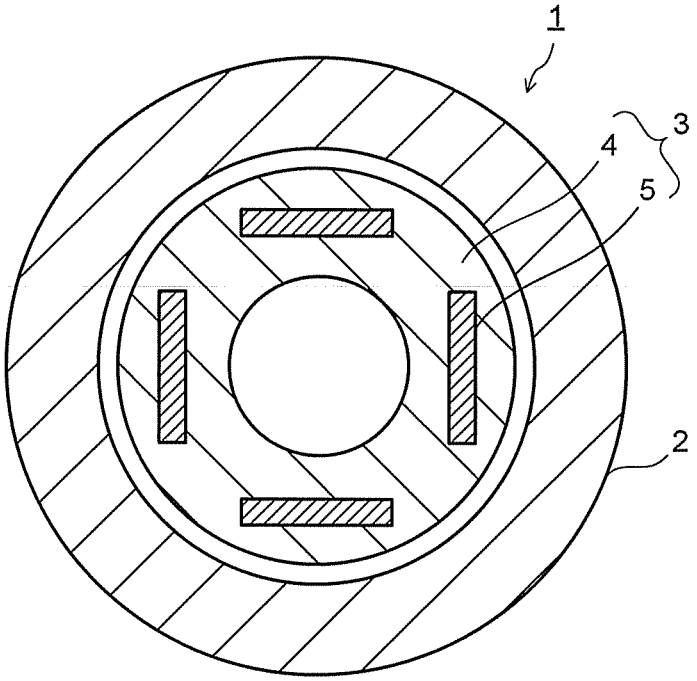
FIG. 2 is a view showing a permanent magnet motor of an embodiment.

Next, a motor and a power generator of embodiments will be described with reference to the drawings. FIG. 2 shows a permanent magnet motor according to an embodiment. In the permanent magnet motor 1 shown in FIG. 2, a rotor (rotating part) 3 is disposed in a stator (stationary part) 2. In an iron core 4 of the rotor 3, the permanent magnets 5 of the embodiment are disposed. Based on the properties and so on of the permanent magnets of the embodiment, it is possible to realize efficiency enhancement, downsizing, cost reduction, and so on of the permanent magnet motor 1.

Figure 3:
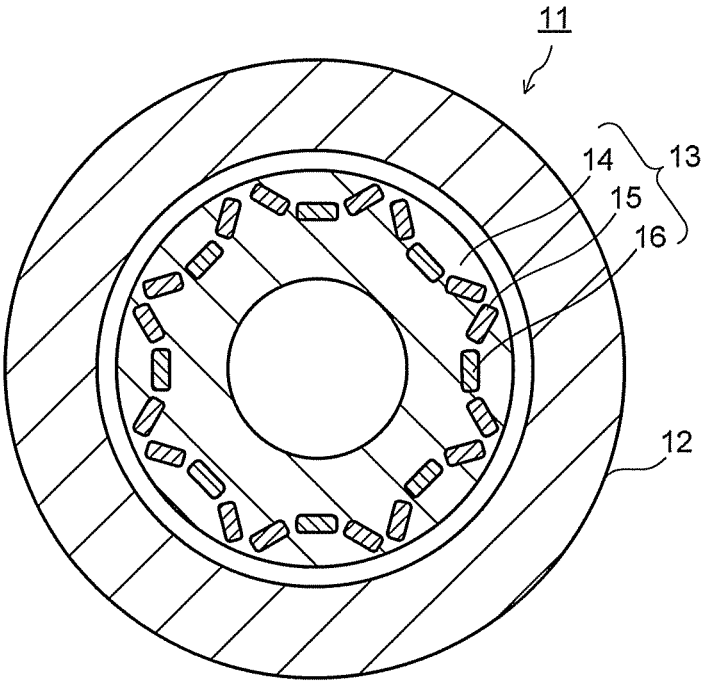
FIG. 3 is a view showing a variable magnetic flux motor of an embodiment.

FIG. 3 shows a variable magnetic flux motor according to an embodiment. In the variable magnetic flux motor 11 shown in FIG. 3, a rotor (rotating part) 13 is disposed in a stator (stationary part) 12. In an iron core 14 of the rotor 13, the permanent magnets of the embodiment are disposed as stationary magnets 15 and variable magnets 16. Magnetic flux density (flux quantum) of the variable magnets 16 is variable. The variable magnets 16 are not influenced by a Q-axis current because their magnetization direction is orthogonal to a Q-axis direction, and can be magnetized by a D-axis current. In the rotor 13, a magnetized winding (not shown) is provided. When a current is passed through the magnetized winding from a magnetizing circuit, its magnetic field acts directly on the variable magnets 16.

According to the permanent magnet of the embodiment, it is possible to obtain a suitable coercive force in the stationary magnets 15. When the permanent magnets of the embodiment are applied to the variable magnets 16, the coercive force is controlled to, for example, a 100 kA/m to 500 kA/m range by changing the various conditions (aging condition and so on) of the aforesaid manufacturing method. In the variable magnetic flux motor 11 shown in FIG. 3, the permanent magnets of the embodiment are usable as both of the stationary magnets 15 and the variable magnets 16, but the permanent magnets of the embodiment may be used as either of the magnets. The variable magnetic flux motor 11 is capable of outputting a large torque with a small device size and thus is suitable for motors of hybrid vehicles, electric vehicles, and the like whose motors are required to have a high output and a small size.

Figure 4:
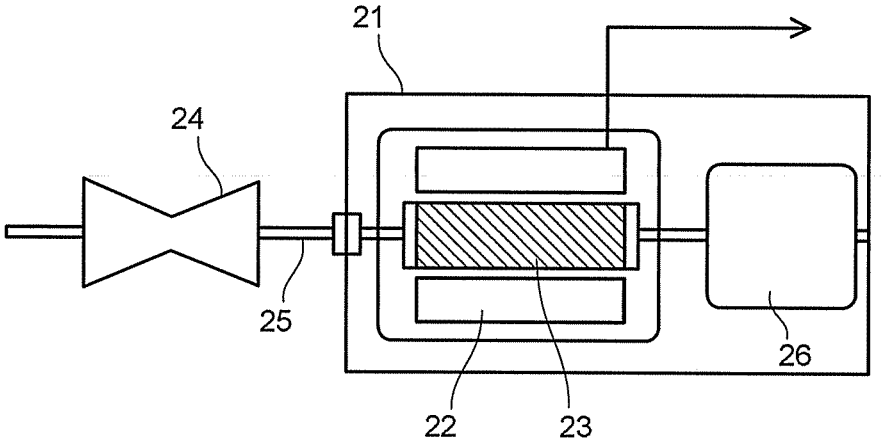
FIG. 4 is a view showing a power generator of an embodiment.

FIG. 4 shows a power generator according to an embodiment. The power generator 21 shown in FIG. 4 includes a stator (stationary part) 22 using the permanent magnet of the embodiment. A rotor (rotating part) 23 disposed inside the stator (stationary part) 22 is connected via a shaft 25 to a turbine 24 provided at one end of the power generator 21. The turbine 24 rotates by an externally supplied fluid, for instance. Incidentally, instead of the turbine 24 rotating by the fluid, it is also possible to rotate the shaft 25 by the transmission of dynamic rotation such as regenerative energy of a vehicle. As the stator 22 and the rotor 23, various kinds of generally known structures are adoptable.

The shaft 25 is in contact with a commutator (not shown) disposed on the rotor 23 opposite the turbine 24, and an electromotive force generated by the rotation of the rotor 23 is boosted to system voltage to be transmitted as an output of the power generator 21 via an isolated phase bus and a traction transformer (not shown). The power generator 21 may be either of an ordinary power generator and a variable magnetic flux power generator. Note that the rotor 23 is electrically charged due to an axial current accompanying static electricity from the turbine 24 and the power generation. Therefore, the power generator 21 includes a brush 26 for discharging the charged electricity of the rotor 23.

Next, examples and their evaluation results will be described.

Examples 1, 2

After raw materials were weighed and mixed at predetermined ratios, the resultants were arc-melted in an Ar gas atmosphere, whereby alloy ingots were fabricated. After the alloy ingots were heat-treated at 1170° C. for one hour, they were roughly ground and then finely ground by a jet mill, whereby alloy powders as raw material powders of permanent magnets were prepared. The alloy powders were press-formed in a magnetic field, whereby compression-molded bodies were fabricated. Next, the compression-molded bodies of the alloy powders were each disposed in a chamber of a firing furnace, and the chamber was vacuum-exhausted until its degree of vacuum became $9.5\times10^{-3}$ Pa. In this state, a temperature in the chamber was raised up to 1180° C., and thereafter Ar gas was led into the chamber. The temperature in the chamber set to the Ar atmosphere was raised up to 1195° C., and while this temperature was kept for three hours, main sintering was performed. Sintering conditions are shown in Table 2.

Subsequently to the main sintering step, the sintered compacts were kept at 1140° C. for three hours and were subjected to solution treatment. Next, after the sintered compacts having undergone the solution treatment were kept at 740° for two hours, they were gradually cooled to room temperature and were further kept at 820° C. for 28 hours. After the sintered compacts having undergone aging under such conditions were gradually cooled to 410° C., they were cooled in the furnace to room temperature, whereby desired sintered magnets were obtained. The compositions of the sintered magnets are as shown in Table 1. Composition analysis of the magnets was conducted by the inductively coupled plasma (ICP) method. Following the aforesaid method, a density of each of the sintered compacts, a Cu concentration in a cell wall phase, and a full width at half maximum of a Cu concentration profile in the cell wall phase were measured. Further, magnetic properties of the sintered magnets were evaluated by a BH tracer and their coercive force and residual magnetization were measured. The results are shown in Table 3.

Note that the composition analysis by the ICP method was done in the following procedure. First, a sample picked up from the aforesaid measurement points was ground in a mortar, and a predetermined amount of this ground sample was weighed to be put into a quartz beaker. A mixed acid (containing nitric acid and hydrochloric acid) is put into the quartz beaker, which is heated to about 140° C. on a hotplate, whereby the sample is completely melted. After it is left standing to cool, it is transferred to a PFA volumetric flask and is subjected to an isovolumetric process to be a sample solution. Quantities of components of the sample solution were determined by a calibration curve method with use of an ICP emission spectrochemical analyzer. As the ICP emission spectrochemical analyzer, SPS4000 (trade name) manufactured by SII Nano Technology Inc. was used.

Examples 3, 4

After raw materials were weighed and mixed at predetermined ratios, the resultants were high-frequency melted in an Ar gas atmosphere, whereby alloy ingots were fabricated. After the alloy ingots were heat-treated at 1170° C. for one hour, they were roughly ground and then finely ground by a jet mill, whereby alloy powders as raw material powders of permanent magnets were prepared. The alloy powders were press-formed in a magnetic field, whereby compression-molded bodies were fabricated. Next, the compression-molded bodies of the alloy powders were disposed in a chamber of a firing furnace, and the chamber was vacuum-exhausted until its degree of vacuum became $9.5\times10^{-3}$ Pa. In this state, a temperature in the chamber was raised up to 1185° C., and thereafter, Ar gas was led into the chamber. The temperature in the chamber set to the Ar atmosphere was raised up to 1195° C., and while this temperature was kept for three hours, main sintering was performed. Subsequently, while the sintered compacts were kept at 1130° C. for four hours, they were subjected to solution treatment.

Next, after the sintered compacts having undergone the solution treatment were kept at 750° for one hour, they were gradually cooled to room temperature. Subsequently, after they were kept at 800° C. for 40 hours, they were gradually cooled to 400° C., and were further cooled in the furnace to room temperature, whereby desired sintered magnets were obtained. The compositions of the sintered magnets are as shown in Table 1. Regarding each of the obtained sintered magnets, a density of a sintered compact, a Cu concentration in a cell wall phase, a full width at half maximum of a concentration profile of Cu in the cell wall phase, a coercive force, and residual magnetization were measured in the same manner as in the example 1. The measurement results are shown in Table 3.

Example 5

Alloy powder having the same composition as that of the example 4 was press-formed in a magnetic field, whereby a compression-molded body was fabricated. This compression-molded body was disposed in a chamber of a firing furnace, and the chamber was vacuum-exhausted until its degree of vacuum became $9.5\times10^{-3}$ Pa. In this state, a temperature in the chamber was raised up to 1190° C., and thereafter, Ar gas was led into the chamber. The temperature in the chamber set to the Ar atmosphere was raised up to 1195° C., and while this temperature was kept for three hours, main sintering was performed. Subsequently, solution treatment and aging were performed under the same conditions as those of the example 4, whereby a desired sintered magnet was obtained. The composition of the sintered magnet is as shown in Table 1. Regarding the obtained sintered magnet, a density of a sintered compact, a Cu concentration in a cell wall phase, a full width at half maximum of a concentration profile of Cu in the cell wall phase, a coercive force, and residual magnetization were measured in the same manner as in the example 1. The measurement results are shown in Table 3.

Example 6

Alloy powder having the same composition as that of the example 4 was press-formed in a magnetic field, whereby a compression-molded body was fabricated. This compression-molded body was disposed in a chamber of a firing furnace, and the chamber was vacuum-exhausted until its degree of vacuum became $9.5\times10^{-3}$ Pa. In this state, a temperature in the chamber was raised up to 1160° C., and thereafter, Ar gas was led into the chamber. The temperature in the chamber set to the Ar atmosphere was raised up to 1195° C., and while this temperature was kept for three hours, main sintering was performed. Next, solution treatment and aging were performed under the same conditions as those of the example 4, whereby a desired sintered magnet was obtained. The composition of the sintered magnet is as shown in Table 1. Regarding the obtained sintered magnet, a density of a sintered compact, a Cu concentration in a cell wall phase, a full width at half maximum of a concentration profile of Cu in the cell wall phase, a coercive force, and residual magnetization were measured in the same manner as in the example 1. The measurement results are shown in Table 3.

Examples 7, 8

Alloy powders having the same compositions as those of the example 3, 4 were press-formed in a magnetic field, whereby compression-molded bodies were fabricated. The compression-molded bodies were disposed in a chamber of a firing furnace, and the chamber was vacuum-exhausted until its degree of vacuum became $2.5\times10^{-2}$ Pa. In this state, a temperature in the chamber was raised up to 1180° C., and thereafter, Ar gas was led into the chamber. The temperature in the chamber set to the Ar atmosphere was raised up to 1195° C., and while this temperature was kept for three hours, main sintering was performed. Next, solution treatment and aging were performed under the same conditions as those of the examples 3, 4, whereby desired sintered magnets were obtained. The compositions of the sintered magnets are as shown in Table 1. Regarding each of the obtained sintered magnets, a density of a sintered compact, a Cu concentration in a cell wall phase, a full width at half maximum of a concentration profile of Cu in the cell wall phase, a coercive force, and residual magnetization were measured in the same manner as in the example 1. The measurement results are shown in Table 3.

Example 9

Alloy powder having the same composition as that of the example 4 was press-formed in a magnetic field, whereby a compression-molded body was fabricated. This compression-molded body was disposed in a chamber of a firing furnace, and the chamber was vacuum-exhausted until its degree of vacuum became $9.5\times10^{-3}$ Pa. In this state, a temperature in the chamber was raised up to 1160° C., and after this temperature was kept for five minutes, Ar gas was led into the chamber. The temperature in the chamber set to the Ar atmosphere was raised up to 1195° C., and while this temperature was kept for three hours, main sintering was performed. Next, solution treatment and aging were performed under the same conditions as those of the example 4, whereby a desired sintered magnet was obtained. The composition of the sintered magnet was as shown in Table 1. Regarding the obtained sintered magnet, a density of a sintered compact, a Cu concentration in a cell wall phase, a full width at half maximum of a concentration profile of Cu in the cell wall phase, a coercive force, and residual magnetization were measured in the same manner as in the example 1. The measurement results are shown in Table 3.

Example 10

Alloy powder having the same composition as that of the example 4 was press-formed in a magnetic field, whereby a compression-molded body was fabricated. This compression-molded body was disposed in a chamber of a firing furnace, and the chamber was vacuum-exhausted until its degree of vacuum became $9.5\times10^{-3}$ Pa. In this state, a temperature in the chamber was raised up to 1160° C., and after this temperature was kept for five minutes, it was decreased to room temperature. Next, Ar gas was led into the chamber in the room temperature state, the temperature was raised up to 1200° C., and while this temperature was kept for three hours, main sintering was performed. Next, solution treatment and aging were performed under the same conditions as those of the example 4, whereby a desired sintered magnet was obtained. The composition of the sintered magnet is as shown in Table 1. Regarding the obtained sintered magnet, a density of a sintered compact, a Cu concentration in a cell wall phase, a full width at half maximum of a concentration profile of Cu in the cell wall phase, a coercive force, and residual magnetization were measured in the same manner as in the example 1. The measurement results are shown in Table 3.

Comparative Example 1

A sintered magnet having the composition shown in Table 1 was fabricated by employing the same manufacturing method as that of the example 1. Regarding the obtained sintered magnet, a density of a sintered compact, a Cu concentration in a cell wall phase, a full width at half maximum of a concentration profile of Cu in the cell wall phase, a coercive force, and residual magnetization were measured in the same manner as in the example 1. The measurement results are shown in Table 3.

Comparative Example 2

A sintered magnet having the composition shown in Table 1 was fabricated by employing the same manufacturing method as that of the example 3. Regarding the obtained sintered magnet, a density of a sintered compact, a Cu concentration in a cell wall phase, a full width at half maximum of a concentration profile of Cu in the cell wall phase, a coercive force, and residual magnetization were measured in the same manner as in the example 1. The measurement results are shown in Table 3.

Comparative Example 3

Alloy powder having the same composition as that of the example 4 was press-formed in a magnetic field, whereby a compression-molded body was fabricated. This compression-molded body was disposed in a chamber of a firing furnace, and the chamber was vacuum-exhausted until its degree of vacuum became $9.5\times10^{-3}$ Pa. In this state, a temperature in the chamber was raised up to 1130° C., and thereafter, Ar gas was led into the chamber. The temperature in the chamber set to the Ar atmosphere was raised up to 1195° C., and while this temperature was kept for three hours, main sintering was performed. Next, solution treatment and aging were performed under the same conditions as those of the example 4, whereby a desired sintered magnet was obtained. The composition of the sintered magnet is as shown in Table 1. Regarding the obtained sintered magnet, a density of a sintered compact, a Cu concentration in a cell wall phase, a full width at half maximum of a concentration profile of Cu in the cell wall phase, a coercive force, and residual magnetization were measured in the same manner as in the example 1. The measurement results are shown in Table 3.

Comparative Example 4

Alloy powder having the same composition as that of the example 4 was press-formed in a magnetic field, whereby a compression-molded body was fabricated. This compression-molded body was disposed in a chamber of a firing furnace, and the chamber was vacuum-exhausted until its degree of vacuum became $9.5\times10^{-3}$ Pa. In this state, a temperature in the chamber was raised up to 1140° C., and thereafter, Ar gas was led into the chamber. The temperature in the chamber set to the Ar atmosphere was raised up to 1195° C., and while this temperature was kept for three hours, main sintering was performed. Next, solution treatment and aging were performed under the same conditions as those of the example 4, whereby a desired sintered magnet was obtained. The composition of the sintered magnet is as shown in Table 1. Regarding the obtained sintered magnet, a density of a sintered compact, a Cu concentration in a cell wall phase, a full width at half maximum of a concentration profile of Cu in the cell wall phase, a coercive force, and residual magnetization were measured in the same manner as in the example 1. The measurement results are shown in Table 3.

TABLE 1

| | Composition of Magnet (at %) |
|---|---|
| Example 1 | $Sm_{11.36}Fe_{28.36}(Zr_{0.83}Ti_{0.17})_{2.66}Cu_{7.09}Co_{50.53}$ |
| Example 2 | $(Sm_{0.88}Nd_{0.12})_{11.11}Fe_{29.16}Zr_{2.04}Cu_{5.33}Co_{52.36}$ |
| Example 3 | $Sm_{11.47}Fe_{29.84}Cu_{5.58}Zr_{2.39}(Co_{0.998}Cr_{0.002})_{50.72}$ |
| Example 4 | $Sm_{11.07}Fe_{30.68}Cu_{5.25}Zr_{2.01}Co_{50.99}$ |
| Example 5 | $Sm_{11.07}Fe_{30.68}Cu_{5.25}Zr_{2.01}Co_{50.99}$ |
| Example 6 | $Sm_{11.07}Fe_{30.68}Cu_{5.25}Zr_{2.01}Co_{50.99}$ |
| Example 7 | $Sm_{11.47}Fe_{29.84}Cu_{5.58}Zr_{2.39}(Co_{0.998}Cr_{0.002})_{50.72}$ |
| Example 8 | $Sm_{11.07}Fe_{30.68}Cu_{5.25}Zr_{2.01}Co_{50.99}$ |
| Example 9 | $Sm_{11.07}Fe_{30.68}Cu_{5.25}Zr_{2.01}Co_{50.99}$ |
| Example 10 | $Sm_{11.07}Fe_{30.68}Cu_{5.25}Zr_{2.01}Co_{50.99}$ |
| Comparative Example 1 | $Sm_{11.36}Fe_{24.82}(Zr_{0.83}Ti_{0.17})_{2.66}Cu_{7.09}Co_{54.07}$ |
| Comparative Example 2 | $Sm_{10.73}Fe_{30.80}Cu_{5.27}Zr_{2.02}Co_{51.18}$ |
| Comparative Example 3 | $Sm_{11.07}Fe_{30.68}Cu_{5.25}Zr_{2.01}Co_{50.99}$ |
| comparative example 4 | $Sm_{11.07}Fe_{30.68}Cu_{5.25}Zr_{2.01}Co_{50.99}$ |

TABLE 2

| | Pre-Process Step (vacuum process step) | | | Main |
|---|---|---|---|---|
| | Process Temperature T (Atmosphere Change Temperature) [° C.] | Degree of Vacuum [$\times10^{-3}$ Pa] | Retention Time [minute] | Sintering Step Main Sintering Temperature Ts [° C.] |
| Example 1 | 1180 | 9.5 | — | 1195 |
| Example 2 | 1180 | 9.5 | — | 1195 |
| Example 3 | 1185 | 9.5 | — | 1195 |
| Example 4 | 1185 | 9.5 | — | 1195 |
| Example 5 | 1190 | 9.5 | — | 1195 |
| Example 6 | 1160 | 9.5 | — | 1195 |
| Example 7 | 1180 | 2.5 × 10 | — | 1195 |
| Example 8 | 1180 | 2.5 × 10 | — | 1195 |
| Example 9 | 1160 | 9.5 | 5 | 1195 |
| Example 10 | 1160 | 9.5 | 5 | 1200 |
| Comparative Example 1 | 1180 | 9.5 | — | 1195 |
| Comparative Example 2 | 1185 | 9.5 | — | 1195 |
| Comparative Example 3 | 1130 | 9.5 | — | 1195 |
| Comparative Example 4 | 1140 | 9.5 | — | 1195 |

TABLE 3

| | Density of Sintered Compact [$\times 10^3$ kg/m$^3$] | Cu Concentration in Cell Wall Phase [at %] | Full Width at Half Maximum of Cu concentration Profile in Cell Wall Phase | Coercive Force [kA/m] | Residual Magnetization [T] |
|---|---|---|---|---|---|
| Example 1 | 8.29 | 49.1 | 5.4 | 1290 | 1.18 |
| Example 2 | 8.28 | 39.4 | 3.7 | 1120 | 1.20 |
| Example 3 | 8.31 | 45.2 | 2.2 | 1080 | 1.22 |
| Example 4 | 8.28 | 54.2 | 2.8 | 1160 | 1.23 |
| Example 5 | 8.29 | 58.7 | 2.4 | 1180 | 1.24 |
| Example 6 | 8.27 | 52.4 | 2.5 | 1090 | 1.23 |
| Example 7 | 8.27 | 40.1 | 6.1 | 990 | 1.16 |
| Example 8 | 8.25 | 37.3 | 5.4 | 870 | 1.21 |
| Example 9 | 8.30 | 59.5 | 2.3 | 1210 | 1.23 |
| Example 10 | 8.31 | 57.7 | 1.8 | 1190 | 1.23 |
| Comparative Example 1 | 8.29 | 47.2 | 6.2 | 1850 | 1.12 |
| Comparative Example 2 | 8.03 | 16.2 | 4.0 | 110 | 1.14 |
| Comparative Example 3 | 7.70 | 19.4 | 3.4 | 240 | 1.07 |
| Comparative Example 4 | 7.95 | 28.9 | 3.1 | 410 | 1.11 |

As is apparent from Table 3, it is seen that the sintered magnets of the examples 1 to 10 all have a high density and have a sufficiently increased Cu concentration in the cell wall phase, and as a result, they all have high magnetization and a high coercive force. Having a low Fe concentration, the sintered magnet of the comparative example 1 has low magnetization even though the density is high. Having a low Sm concentration, the sintered magnet of the comparative example 2 is low both in the magnetization and the coercive force. The sintered magnets of the comparative examples 3, 4 are low in the density of the sintered compact, and are low both in the magnetization and the coercive force due to the low Cu concentration in the cell wall phase.

Further, in the sintered magnet of the example 4, the compositions of the cell phase and the cell wall phase were measured according to the aforesaid method. As a result, the composition of the cell phase was $Sm_{14.5}Fe_{34.9}Z_{1.3}Cu_{2.3}Co_{47.0}$ and the composition of the cell wall phase was $Sm_{21.1}Fe_{8.8}Z_{1.5}Cu_{54.2}Co_{14.4}$. When the compositions of the cell phase and the cell wall phase were measured in the other examples, it was confirmed that the cell wall phase is higher in the Cu concentration and the Sm concentration and lower in the Fe concentration compared with the composition of the whole, and the cell phase is lower in the Cu concentration and the Sm concentration compared with the composition of the whole. It is seen from this that the cell phase preferably has the composition expressed by the aforesaid formula (2) and the cell wall phase preferably has the composition expressed by the aforesaid formula (3).

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the methods described herein may be made without departing from the spirit of the inventions. The accompanying claims and their equivalents are intended to cover such forms or modifications as would fall within the scope and spirit of the inventions.

What is claimed is:

1. A permanent magnet comprising a sintered compact, the sintered compact comprising:

a composition expressed by the following composition formula:

$$R_pFe_qM_rCu_sCo_{100-p-q-r-s}$$

wherein, R is at least one element selected from the group consisting of rare-earth elements, M is at least one element selected from the group consisting of Zr, Ti, and Hf, p is a number satisfying $10.8 \leq p \leq 13.5$ at %, q is a number satisfying $28 \leq q \leq 40$ at %, r is a number satisfying $0.88 \leq r \leq 7.2$ at %, and s is a number satisfying $3.5 \leq s \leq 13.5$ at %; and a metallic structure including a cell phase having a $Th_2Zn_{17}$ crystal phase, and a cell wall phase surrounding the cell phase, wherein a Cu concentration in the cell wall phase is in a range from 30 at % to 70 at %, and an Fe concentration in the cell wall phase is in a range from 4 at % to 20 at %, wherein a full width at half maximum of a Cu concentration profile in the cell wall phase is 6.1 nm or less, wherein the cell phase has a composition expressed by the following composition formula:

$$R_{p1}Fe_{q1}M_{r1}Cu_{s1}Co_{100-p1-r1-s1}$$

wherein p1 is a number satisfying $8 \leq p1 \leq 18$ at %, q1 is s number satisfying $28 \leq q1 \leq 45$ at %, r1 is a number satisfying $0.1 \leq r1 \leq 3$ at %, and s1 is a number satisfying $0.5 \leq s1 \leq 10$ at %; and wherein the cell wall phase has a composition expressed by the following composition formula:

$$R_{p2}Fe_{q2}M_{r2}Cu_{s2}Co_{100-p2-q2-r2-s2}$$

wherein, p2 is a number satisfying $12 \leq p2 \leq 28$ at %, q2 is a number satisfying $4 \leq q2 \leq 20$ at %, r2 is a number satisfying $0.1 \leq r2 \leq 3$ at %, and s2 is a number satisfying $30 \leq s2 \leq 70$ at %.

2. The permanent magnet according to claim 1, wherein the Cu concentration in the cell wall phase is in a range from 35 at % to 60 at %.

3. The permanent magnet according to claim 1, wherein the full width at half maximum of the Cu concentration profile in the cell wall phase is 5 nm or less.

4. The permanent magnet according to claim 1, wherein a coercive force of the permanent magnet is 800 kA/m or more, and residual magnetization of the permanent magnet is 1.15 T or more.

5. The permanent magnet according to claim 1, wherein 50 at % or more of the element R is Sm, and 50 at % or more of the element M is Zr.

6. A motor comprising the permanent magnet according to claim 1.

7. The motor according to claim 6, further comprising:

a stator; and a rotor, arranged in the stator, comprising the permanent magnet.

8. A vehicle comprising the motor according to claim 6.

9. A power generator comprising the permanent magnet according to claim 1.

10. The power generator according to claim 9, further comprising:

a stator comprising the permanent magnet; and a rotor arranged in the stator.

11. A vehicle comprising the power generator according to claim 9.

12. The permanent magnet according to claim 1, wherein the r is a number satisfying $2.01 \leq r \leq 7.2$ at %.

13. The permanent magnet according to claim 1, wherein the q is a number satisfying $30 \leq r \leq 40$ at %.

14. The permanent magnet according to claim 1, wherein the r is a number satisfying $2.39 \leq r \leq 7.2$ at %.

15. The permanent magnet according to claim 1, wherein the sintered compact has a density of $8.2 \times 10^3$ kg/m$^3$ or more.

16. A permanent magnet comprising a sintered compact, the sintered compact comprising:

a composition expressed by the following composition formula:

$$R_pFe_qM_rCu_s(Co_{1-t}A_t)_{100-p-q-r-s}$$

wherein, R is at least one element selected from the group consisting of rare-earth elements, M is at least one element selected from the group consisting of Zr, Ti, and Hf, A is at least one element selected from the group consisting of Ni, V, Cr, Mn, Al, Ga, Nb, Ta, and W, p is a number satisfying $10.8 \leq p \leq 13.5$ at %, q is a number satisfying $28 \leq q \leq 40$ at %, r is a number satisfying $0.88 \leq r \leq 7.2$ at %, s is a number satisfying $3.5 \leq s \leq 13.5$ at %, and t is a number of an atomic ratio satisfying $0 \leq t \leq 0.2$; and a metallic structure including a cell phase having a $Th_2Zn_{17}$ crystal phase, and a cell wall phase surrounding the cell phase, wherein a Cu concentration in the cell wall phase is in a range from 30 at % to 70 at %, and an Fe concentration in the cell wall phase is in a range from 4 at % to 20 at %, wherein a full width at half maximum of a Cu concentration profile in the cell wall phase is 6.1 nm or less, wherein the cell phase has a composition expressed by the following composition formula:

$$R_{p1}Fe_{q1}M_{r1}Cu_{s1}Co_{100-p1-q1-r1-s1}$$

wherein p1 is a number satisfying $8 \leq p1 \leq 18$ at %, q1 is s number satisfying $28 \leq q1 \leq 45$ at %, r1 is a number satisfying $0.1 \leq r1 \leq 3$ at %, and s1 is a number satisfying $0.5 \leq s1 \leq 10$ at %; and wherein the cell wall phase has a composition expressed by the following composition formula:

$$R_{p2}Fe_{q2}M_{r2}Cu_{s2}Co_{100-p2-q2-r2-s2}$$

wherein, p2 is a number satisfying $12 \leq p2 \leq 28$ at %, q2 is a number satisfying $4 \leq q2 \leq 20$ at %, r2 is a number satisfying $0.1 \leq r2 \leq 3$ at %, and s2 is a number satisfying $30 \leq s2 \leq 70$ at %.

* * * * *